United States Patent [19]

Hennequin

[11] Patent Number: 4,580,753

[45] Date of Patent: Apr. 8, 1986

[54] SUPPORT BRACKET FOR A VENETIAN BLIND HEADRAIL

[75] Inventor: Petrus J. Hennequin, Rotterdam, Netherlands

[73] Assignee: Hunter Douglas International N.V., Rooi Catootje, Netherlands Antilles

[21] Appl. No.: 583,987

[22] Filed: Feb. 27, 1984

[30] Foreign Application Priority Data

Mar. 29, 1983 [GB] United Kingdom ..... 8308640

[51] Int. Cl.[4] ..... A47H 1/10

[52] U.S. Cl. ..... 248/264; 160/178 B

[58] Field of Search ..... 248/264, 262, 263, 254, 248/253; 160/178 R, 178 B; 16/361, 360

[56] References Cited

U.S. PATENT DOCUMENTS

| | | | |
|---|---|---|---|
| 1,431,353 | 10/1922 | Allen | 248/262 |
| 2,267,160 | 12/1941 | McKerlie | 248/264 |
| 2,526,393 | 10/1950 | Nelson | 248/264 |
| 2,680,589 | 6/1954 | Nelson | 248/264 |
| 2,792,999 | 5/1957 | Lorentzen | 248/264 |
| 4,177,853 | 12/1979 | Anderson et al. | 160/178 R X |
| 4,265,423 | 5/1981 | Vecchiarelli | 248/264 |

FOREIGN PATENT DOCUMENTS

| | | | |
|---|---|---|---|
| 619884 | 3/1949 | United Kingdom | 16/361 |

*Primary Examiner*—Ramon S. Britts
*Assistant Examiner*—David M. Purol
*Attorney, Agent, or Firm*—Pennie & Edmonds

[57] ABSTRACT

A support bracket for a venetian blind headrail which is in the form of an open sided box structure including a top (14), bottom (10) and a side (16) and/or rear wall (12) and a separate front wall (18, 20) which is pivotal about a vertical axis with respect to the top and bottom walls, and which includes top and bottom flanges (22). This pivoting is effected by a pivotal connection including a guide aperture (30) formed preferably in the top and bottom flanges, the aperture providing two guide surfaces (32, 34) angled with respect to one another, a hinge element (28) in the top and bottom walls engaging in each aperture, whereby the front wall can be pivoted between an open position and a closed position transverse to the open position. A latch (38, 40) is provided on the top and bottom flanges and on the top and bottom walls, the latch being spaced from the pivotal connection and prevents pivoting of the front wall away from the closed position. Unlatching is effected by moving the front wall (18, 20) when in its closed position, away from the side wall (16) so that the hinge element moves on one guide surface (32) to the junction of the guide surface and then the front wall can be pivoted to its open position, the hinge element then moving along the other guide surface (34) during the pivoting motion.

8 Claims, 6 Drawing Figures

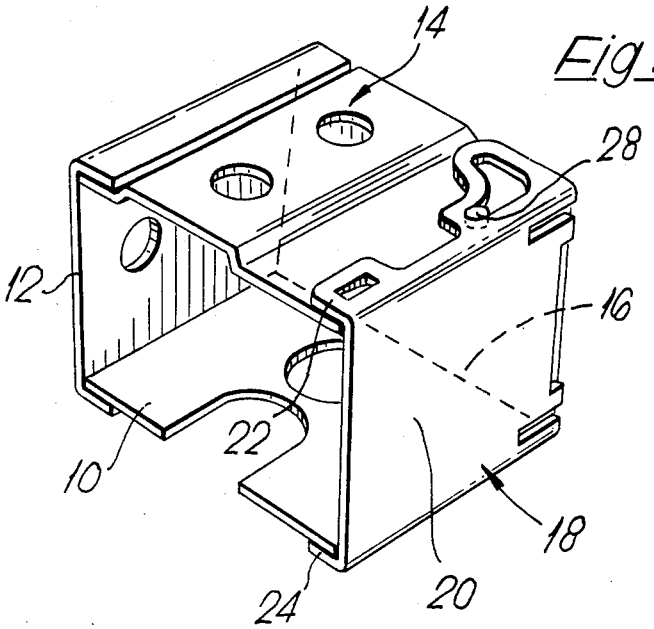
Fig. 1.
Fig. 2.
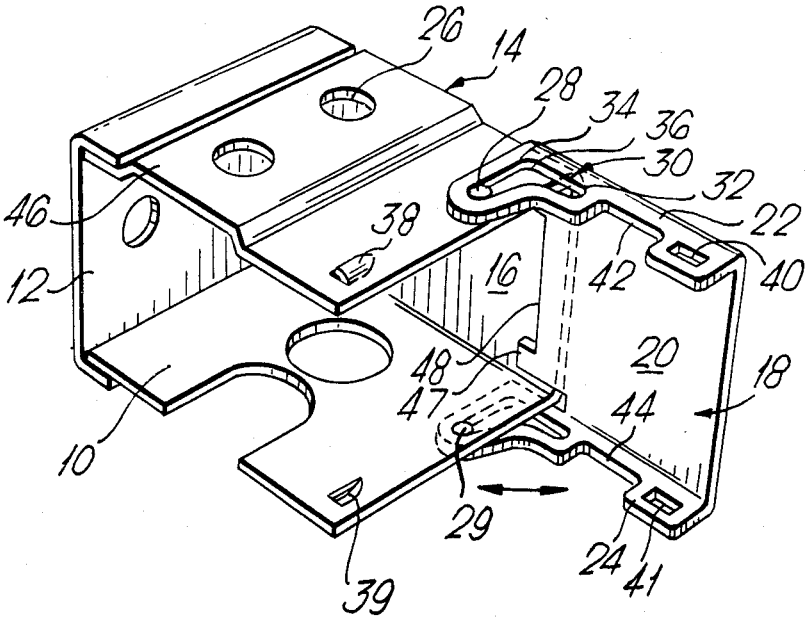

SUPPORT BRACKET FOR A VENETIAN BLIND HEADRAIL

The present invention relates to a support bracket for a venetian blind headrail.

Various forms of such support bracket have been proposed and one is illustrated, for example, in U.S. Pat. No. 4 265 423. This is in the form of an open sided box structure which includes a side wall, with a top wall and a bottom wall connected to the side wall, the front wall having rearwardly extending top and bottom flanges connected to a forward portion of the top wall, respectively, by a vertical axis pivotal connection adjacent the side wall, a latch being provided between the top and bottom flanges and the top and bottom walls, the latch locking the front wall in position when the front wall is moved sideways towards the side wall. In this way the front wall can be opened so that the headrail can be introduced into the box-like structure and thereafter the front wall is closed to secure the wall in place. The connection between the front wall and the top and bottom walls comprises a pin or upset portion of the top and bottom flanges of the front wall engaging in a slot in the front portions of the top and bottom walls respectively.

While this is reasonably satisfactory certain problems do arise. For example as the front wall is pivoted to the open position the edge of the front wall adjacent the hinge tends to abut the front of the headrail, when this is in place, and this tends to obstruct the opening motion of the front wall.

It is now proposed, according to the present invention to provide a support bracket for a venetian blind headrail, in the form of an open sided box structure, comprising, in combination:

(a) a top wall;

(b) a bottom wall;

(c) a further wall connecting said top and bottom walls;

(d) a separate front wall;

(e) vertical pivotal connection members formed by top and bottom flanges of the front wall and the top and bottom walls respectively, said pivotal connection being near the ends of the bracket as viewed end on, said pivotal connection including respective guide means including respective pairs of guide surfaces angled with respect to one another, formed in the top wall or top flange and in the bottom wall or bottom flange, hinge elements in the other of said members engaged in the respective guide means whereby said front wall can be pivoted between an open position and a closed position transverse to said open position; and (f) latch means on at least one of said top wall or top flange and said bottom wall or bottom flange, said latch means being spaced from said pivotal connection, effective to prevent pivoting of said front wall away from the closed position of the bracket, unlatching being effected by moving said front wall, when in its closed position, away from the side wall, so each hinge element moves along one of the guide surfaces to the junction of the guide surfaces, and then the front wall can be pivoted to its open position, the hinge elements moving onto the other guide surface during the pivoting motion.

The guide means may be provided by suitably shaped apertures, or recesses, in the walls/flanges.

Such a structure, because of the provision of the guide means overcomes the problems mentioned above and enables the front wall to move from the closed to the open position even though the edge abuts the front of the headrail, the arrangement being such that the hinge element, for example a pivot pin, moves along one guide surface, to the junction of the two guide surfaces, and then along the other guide surface allowing a certain freedom of movement of the front wall during the pivoting action.

Preferably the guide means are formed in the top and bottom flanges of the front wall and the further wall and the top and bottom walls are formed of metal and the hinge element is deformed out of or formed on the metal, and the front wall is formed of a plastics material, preferably a transparent plastics material. By providing the hinge elements in this way undue wear on the plastics material of the front wall is not encountered. It is advantageous to have a transparent plastics material front wall since one can see the headrail through this front wall and this is more attractive especially when the headrail is formed of a coloured material.

The latch means may comprise a projection on the top and/or bottom wall and a cooperating aperture in the top and/or bottom flange of the front wall, a recess or notch, open at the rear of the respective flange, when the front wall is closed, each recess or notch respectively overlying the projection or projections when the front wall is in the closed, but unlatched position, enabling the front wall to be pivoted to the open position without friction.

Preferably the construction is one in which the top and bottom flanges of the front wall are located above the top wall and below the bottom wall respectively and the top wall has a raised portion behind that part thereof which the top flange overlies, so that the top wall can be secured to the top of a window opening without impeding the movement of the top flange during the closing of the front wall.

In order that the present invention may more readily be understood the following description is given, merely by way of example, reference being made to the accompanying drawings in which:

FIG. 1 is a perspective view of one embodiment of a support bracket according to the present invention from above, the front and the open side;

FIG. 2 is a view similar to FIG. 1 but showing the bracket in the open condition.

Figure 3:
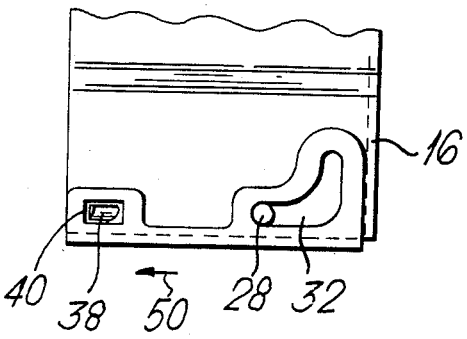
FIGS. 3, 4, 5 and 6 are schematic top plan views showing the front wall in the closed and latched position, the closed and unlatched position, the open position and in a position prior to latching, respectively.
Figure 4:
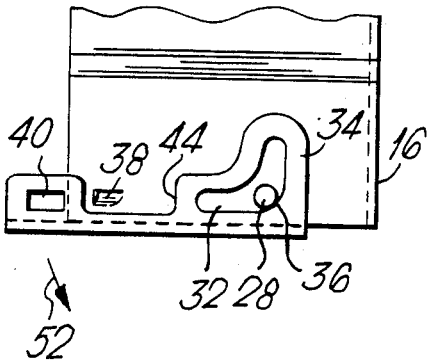
Figure 5:
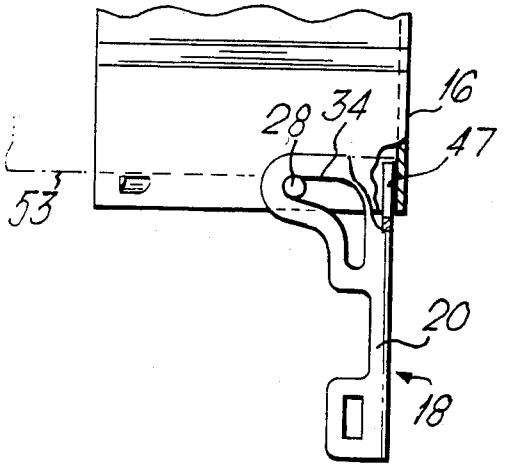
Figure 6:
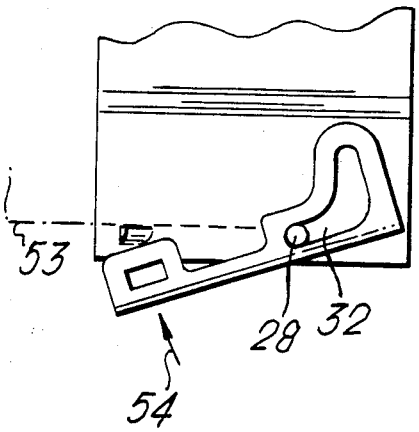

The support bracket illustrated in FIG. 1 can be seen to comprise an open sided box structure having a bottom wall 10, a rear wall 12, a top wall 14, and a side wall 16, which are all rigidly connected to one another and are preferably formed as a one-piece metal stamping. The front of the open box structure is closed by a front wall 18. This front wall is shown as comprising a plastics material, preferably polypropylene, transparent material wall having a main wall portion 20 and top and bottom flanges 22 and 24.

It can be seen that the top, rear and bottom walls are provided with apertures or notches, one of which is indicated by the reference numeral 26, to enable the bracket to be secured to a wall or roof structure.

The front wall 18 is pivotally mounted on the top and bottom walls by a hinge connection. In the construction illustrated this hinge connection comprises a hinge pin 28, 29 on the top and bottom walls 14 and 10, respectively. The top and bottom flanges 22 and 24 are provided with a cooperating guide aperture or slot 30 which has a first arm 32 projecting along the length of the top or bottom and providing a first guide surface and a second arm 34 angled with respect thereto to provide a second guide surface at approximately 90° to the first, the two arms meeting at a curved junction 36.

The side of the aperture opposite the first and second guide surfaces forms a third, curved guide surface extending between their outer ends. This, in effect, constitutes a concave 'hypotenuse' of the right angled triangle defined by the first and second guide surfaces.

The top and bottom walls have a ramp-like latching projection 38, 39 punched out of them respectively, these being located at the left-hand end, remote from the pivot pins 28 and 29, respectively. The top and bottom flanges have cooperating apertures 40 and 41 and generally square shaped notches 42, 44 which are open at the rear edge of the top and bottom flanges respectively.

It can be seen, in particular from FIGS. 1 and 2, that the centre portion 46 of the top wall is raised above the part thereof which includes the hinge pin 28 and the latch projection 38.

If one now refers to FIGS. 3 to 6, it can be seen that the front wall 18 shown in the closed and latched condition in FIG. 3. In this position the hinge-pin 28 is located at the lefthand end of the arm 32 of the aperture 30 and the projection 38 is engaged in the aperture 40 to maintain the front wall in the closed position illustrated. In order to unlatch the front wall, a screwdriver or coin is inserted into a further notch 48 (see FIG. 2) in the righthand side of the front wall 18 and is twisted. This will cause the front wall to move to the left as indicated by the arrow 50 in FIG. 3. The front wall will then take up the position illustrated in FIG. 4 in which the latching projection 38 is disengaged from the aperture 40, but is located in the notch 44. At the same time, the arm 32 of the aperture 30 moves so that the hinge pin 28 is located at the junction 36 of the first and second guide surfaces of the aperture 30. The front wall is now ready to be pivoted in the direction of the arrow 52 in FIG. 4 until it takes up the position illustrated in FIG. 5. By this time the hinge pin 28 will be at the far end of the arm 34 of the aperture 30. Now this arrangement of the aperture is such as to enable the front wall to pivot outwardly freely even though the edge 47 engages against a headrail, the front wall of which is indicated by the dotted line 53 in FIG. 5, which shows a considerable improvement over the structure of U.S. Pat. No. 4 265 423.

Alternatively the edge 47 could engage an offset portion on the top or bottom wall, which causes the front wall to pivot automatically as if it had pressed against the front of a headrail, with the hinge pin 28 moving continuously along the first and second guide surfaces. In this position the outer surface of the main part 20 of the front wall 18 will be adjacent to the inner surface of the side wall and usually between the end of the headrail and the side wall. With the front wall in the open position illustrated in FIG. 5 it is possible readily to remove the headrail. When one wishes to reinsert the headrail one simply pushes it in through the space left by the open front wall and pushes it firmly back until it engages the rear wall 12. Thereafter the front wall is pivoted as indicated by the arrow 54 in FIG. 6 and during this pivoting motion the pivot pin 28 again returns to the lefthand end of the arm 32 of the aperture 30. As the front wall moves to the position of FIG. 6 it is pushed firmly and the flanges 22, 24 spring outwardly slightly as they ride up the ramp-like projection 38 which latches into the aperture 40. Of course a similar latching action is effected by the lower flange 24 on the corresponding projection 39.

Because the front wall is formed of a transparent plastics material if a coloured head-rail is used, as is now quite common, the colour will appear through the transparent front wall, so that the bracket will not appear unsightly.

Either the side wall or the rear wall could be omitted, in which case there would only be one wall joining the top and bottom walls.

I claim:

1. A support bracket for a venetian blind headrail, in the form of an open sided box structure, comprising, in combination:

(a) a top wall;

(b) a bottom wall;

(c) a further wall connecting said top and bottom walls;

(d) a separate front wall;

(e) rearwardly extending top and bottom flanges on the front wall;

(f) vertical pivotal connection members formed by said top and bottom flanges of the front wall and the top and bottom walls respectively, said pivotal connection being near the ends of the bracket as viewed end on, said pivotal connection including respective guide means including respective slots in the top and bottom flanges of the front wall, each slot having a first arm extending generally parallel to said front wall and a second arm angled with respect to the first arm, each of said arms extending from a far end to a symmetrically formed curved smooth junction, hinge elements in the top and bottom walls engaged in the respective slots for relative movement with respect thereto from a first position at far end of the one arms of the slots with the front wall in a closed position, through said junction and to a second position at the far end of the other arms with the front wall in open position and extending transverse to the closed position; and (g) cooperating latch means on at least said top wall and top flange or said bottom wall and bottom flange, said latch means being spaced from said pivotal connection, and aligned in latched engagement with said front wall in said closed position and said hinge elements at the far end of the one arms of said slots to prevent pivoting of said front wall away from the closed position of the bracket, and said front wall being slidably mounted on said hinge means for sliding movement in a direction parallel to the plane of the front wall from a closed position with the latch means in latched engagement to an intermediate position with the hinge elements disposed at said junction and the latch means out of cooperating engagement and with the front wall pivotally disposed for pivoting about said junction and sliding into said open, transversely extending position as a portion of the front wall contacts the headrail and the hinge element moves to the far end of the other arms of the slots.

2. A bracket as claimed in claim 1, wherein the top bottom and further walls are formed of metal, and the hinge element is deformed out of or formed on the metal and wherein the front wall is formed of a plastics material.

3. A bracket as claimed in claim 2, wherein said front wall is formed of a transparent plastics material.

4. A bracket as claimed in claim 1, wherein the latch means comprises a projection on at least one of the top and bottom walls and a cooperating aperture in at least one of the top and bottom flanges of the front wall.

5. A bracket as claimed in claim 4 wherein said at least one of the top and bottom flanges of the front wall further comprises a recess or notch, open at the rear of the respective flange, when the front wall is closed, each recess or notch respectively overlying the projection or projections when the front wall is in the closed, but unlatched position, enabling the front wall to be pivoted to the open position, without friction.

6. A bracket as claimed in claim 1, wherein the top and bottom flanges are located above the top wall and below the bottom wall respectively.

7. A bracket as claimed in claim 6, wherein the top wall further comprises a raised portion behind that part thereof which the top flange overlies.

8. A bracket as claimed in claim 1, wherein the further wall is a side wall connecting the top and bottom walls of the bracket.

* * * * *